US006269961B1

(12) United States Patent
Porcelli

(10) Patent No.: US 6,269,961 B1
(45) Date of Patent: Aug. 7, 2001

(54) FOLDABLE SUPPORT RACK

(75) Inventor: V. Lorenzo Porcelli, Ossining, NY (US)

(73) Assignee: M. Kamenstein, Inc., Elmsford, NY (US)

( * ) Notice: Subject to any disclaimer, the term of this patent is extended or adjusted under 35 U.S.C. 154(b) by 0 days.

(21) Appl. No.: 09/484,393

(22) Filed: Jan. 14, 2000

(51) Int. Cl.[7] ..... A47F 7/00; A47G 29/00

(52) U.S. Cl. ..... 211/70.7; 211/71.01; 211/73; 248/174

(58) Field of Search ..... 211/70.1, 70.7, 211/72, 73, 85.4, 71.01, 85, 126.12, 126.16, 126.4, 26.2; 248/300, 174, 241; 206/45.25, 45.27, 45.29, 45.3, 175–176, 193, 362.4, 395, 784, 525.1, 504

(56) References Cited

U.S. PATENT DOCUMENTS

| | | | | |
|---|---|---|---|---|
| 873,421 | * | 12/1907 | Fleming . | |
| 1,172,667 | * | 2/1916 | Bunnell | 211/85.4 |
| 2,449,530 | * | 9/1948 | Lambert | 248/174 |
| 2,726,835 | * | 12/1955 | Hummel | 248/174 |
| 2,905,332 | * | 9/1959 | Myers | 211/73 |
| 3,002,722 | * | 10/1961 | Cote | 211/73 |
| 3,263,820 | * | 8/1966 | McFadden et al. | 211/60.1 |
| 3,291,365 | * | 12/1966 | Koene | 248/174 |
| 3,462,020 | * | 8/1969 | Hall | 211/73 |
| 4,230,258 | * | 10/1980 | Lane | 206/45.33 |
| 4,858,863 | * | 8/1989 | Lin | 248/174 |
| 4,896,820 | * | 1/1990 | Harrington | 211/73 |
| 4,947,996 | * | 8/1990 | Harris | 211/73 |
| 5,277,388 | * | 1/1994 | Denaro | 248/174 |
| 5,297,677 | * | 3/1994 | Burian et al. | 248/174 |
| 5,411,141 | * | 5/1995 | Bounds | 248/174 |
| 5,641,079 | * | 6/1997 | Schmidt | 211/70.6 |
| 5,971,168 | * | 10/1999 | Proulx | 211/85.4 |

* cited by examiner

*Primary Examiner*—Jerry Redman
*Assistant Examiner*—Jennifer E. Novosad
(74) *Attorney, Agent, or Firm*—Robert A. Koons, Jr.; Matthew P. McWilliams; Pepper Hamilton LLP

(57) ABSTRACT

A foldable support rack having a body member, four hinge portions that are preferably living hinges, tabs extending from opposed ends of the body member, and holes in the body member for engaging the tabs. Additional holes in the body member are dimensioned for receiving articles for support by the rack. The rack is foldable from a first extended position to a second supporting position, forming two portions with triangular cross sections.

12 Claims, 12 Drawing Sheets

10

40

70

FOLDABLE SUPPORT RACK

FIELD OF THE INVENTION

The present invention relates to racks for supporting articles. In particular, the rack of the present invention relates to a rack that is foldable from a generally flat orientation to a deployed, three-dimensional orientation that provides a stable base for supporting various selected articles. The invention is adaptable for providing a wide variety of foldable rack embodiments that can be easily adapted for holding various commonly found articles.

BACKGROUND OF THE INVENTION

Foldable racks of various types are currently available. Some of these folding racks can be made to hold a variety of articles. Foldable racks are available which are made wooden or plastic dowels as part of their framework.

The foldable support racks known have limitations in their use however, because they may be expensive or difficult to manufacture, or their design is not easily adapted to supporting a wide variety of articles to be supported. There remains a need in the art for a foldable support rack that can be manufactured economically, shipped flat to retail stores, stored flat on retail shelves, folded easily by a consumer to a position for use, and which also has a design that lends itself to making embodiments that can be used for supporting a wide variety of articles. The foldable support rack of the present invention as described herein meets these needs.

To overcome the shortcomings of known support racks, I have now designed a new support rack construction.

SUMMARY OF THE INVENTION

Briefly, a foldable support rack is disclosed here that can be readily deployed from a generally flat orientation to a three-dimensional orientation for use as a supporting rack for selected items. The disclosed foldable support rack is particularly useful for holding commonly used household items such as eating utensils. Cooking utensils such as carving knife and fork sets may also be supported by the new rack. Other kitchen items such as wine bottles may also be supported by certain embodiments of the inventive support rack. Commonly used office items may be readily supported on other embodiments of the inventive support rack. Such items include magnetic storage media disks, and optical storage media (compact disks) for computer data. Other embodiments may readily be adapted for holding pens and pencils.

The new foldable support rack can be manufactured by die cutting from a sheet of material such as polyethylene or polypropylene. Alternatively, the support article may be molded from a suitable polymer, such as a polyethylene or polyproplyene. The selection of a particular polymer, or of a particular polymer blend for manufacturing the rack is within the ability of a person of ordinary skill in the art of fabricating similar articles. The material used should be rigid enough for the rack to support the articles that are intended to be supported. Preferably, the material used for the foldable support rack is suited for forming a living hinge. This type of hinge is known in the art, and comprises a linear portion of an article, with reduced thickness and dimensioning that allows an article to be easily folded about the linear portion. The use of a living hinge for folding the foldable support rack is preferred, as this type of hinge reduces the cost of manufacturing the rack.

The new foldable support rack comprises a generally flat body member. The body member is preferably of a rectangular shape. The body member has first and second opposed major faces, and a peripheral edge. The edge comprises first and second opposed side edges. It also comprises first and second opposed ends. The body member has a plurality of tabs disposed along the ends of the peripheral edge. The body member also has a plurality of holes through the body member, these holed being sized and positioned to receive and engage the tabs. The foldable support rack also comprises four hinge portions that are transverse the body member, that is, extending from the first to the second opposed side edge. The hinge portions are spaced apart sufficiently to allow the body member to be folded from a first extended position, to a second supporting position.

The second supporting position is characterized by having the tabs received in and engaged by the body member holes, to secure the folded body member into two segments or portions, these segments or portions having triangular cross sections. The securing tabs should be engaged securely enough to keep the foldable support rack from unfolding easily when the rack is being manually handled and moved about.

An optional stacking member may also be used to engage the opposed sides of a pair of the new foldable support racks, to allow the pair of racks to be stacked one-above-the-other.

It is accordingly an aspect of the invention to provide a foldable support rack where the rack may be manufactured by a die cutting or a molding process.

It is another aspect of the invention to provide a foldable support rack that can be manufactured easily from a polymer material.

It is another aspect of the invention to provide a foldable support rack that is made with living hinges, to reduce the cost of manufacturing.

It is yet another aspect of the invention to provide a new foldable support rack that can be adapted easily to embodiments that are suited to supporting a wide variety of common household or office articles.

These aspects, and others set forth more fully below are achieved by the present invention.

DETAILED DESCRIPTION OF THE INVENTION

Figure 1:
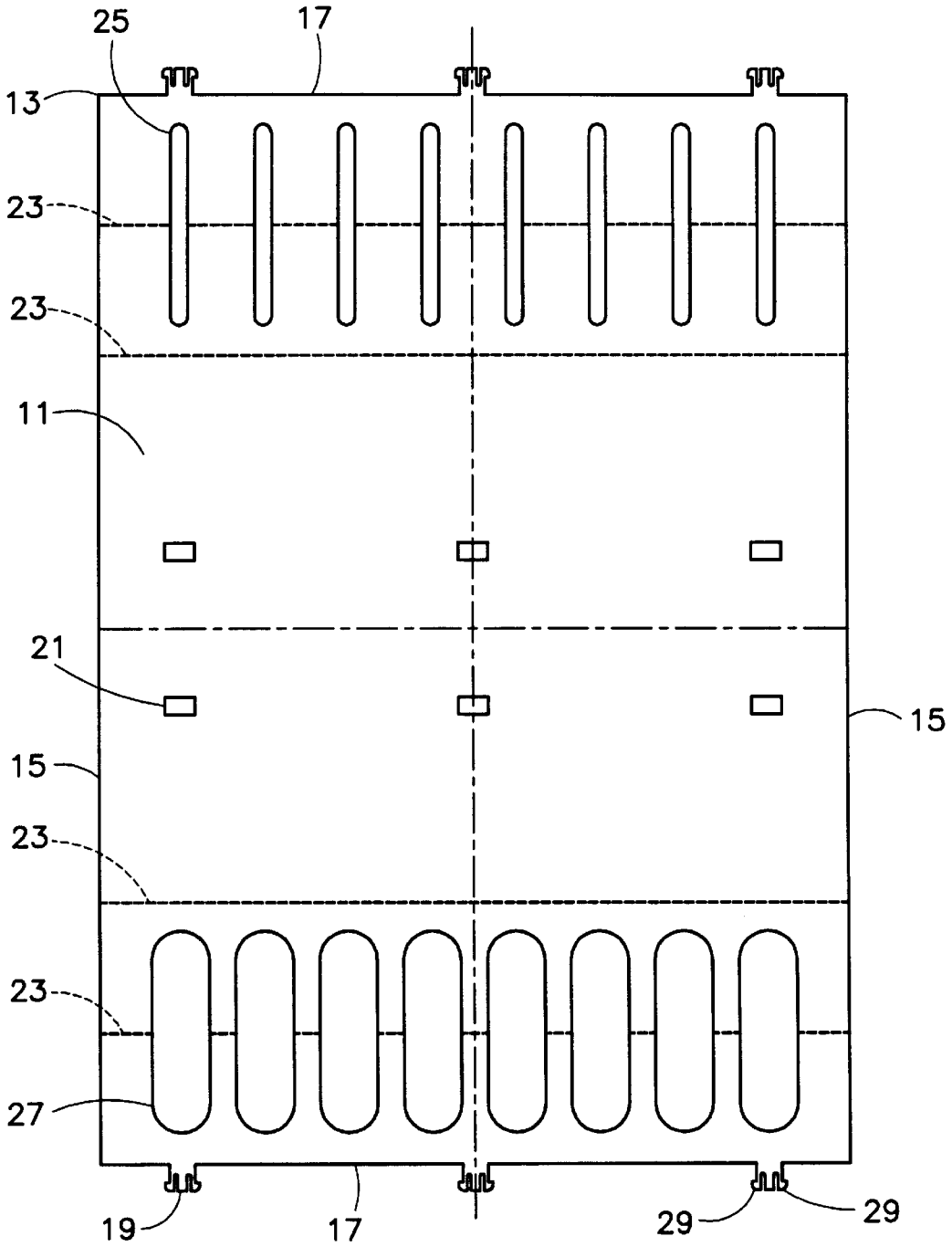
FIG. 1 is an illustration of a top plan view of a first embodiment of a foldable support rack according to the invention.

The new foldable support rack disclosed here will be readily understood by those skilled in the art, by considering the following examples. The examples illustrate several exemplary embodiments of the new rack. These embodiments are depicted in the accompanying drawings. With reference to these drawings, wherein like reference numerals designate similar parts throughout the various views, these embodiments will now be considered.

EXAMPLE 1

FIG. 1 shows a first embodiment 10 of a rack according to the present invention. This embodiment is suited for use supporting one or more knives. This rack consists of a body member 11 that is generally flat and rectangular in shape. The peripheral edge 13 has opposed side edges 15. The body member also has opposed ends 17. Disposed along the ends 17 are securing tabs, with one indicated by 19.

The body member 11 also has a plurality of holes 21 for receiving and engaging the tabs 19. Four spaced apart hinge portions 23, parallel to the ends are shown. These hinge portions 23 are spaced to allow the folding of the body member from a first extended position, being generally flat, to a second supporting position, where the body member forms two portions having triangular cross sections. The body member 11 also has a plurality of holes 25 therethrough of a first size and shape, and a plurality of holes 27 of a second size and shape.

In this embodiment, the securing tabs have prongs 29 disposed along their sides for closely engaging the receiving holes 21. In all of the examples shown here, the hinge portions 23 are living hinges, molded as a feature into the body member. Other types of hinges are to be understood as suitable for use with the inventive rack, such as a piano type hinge. Living hinges are preferred for use with the present rack however.

Figure 3:
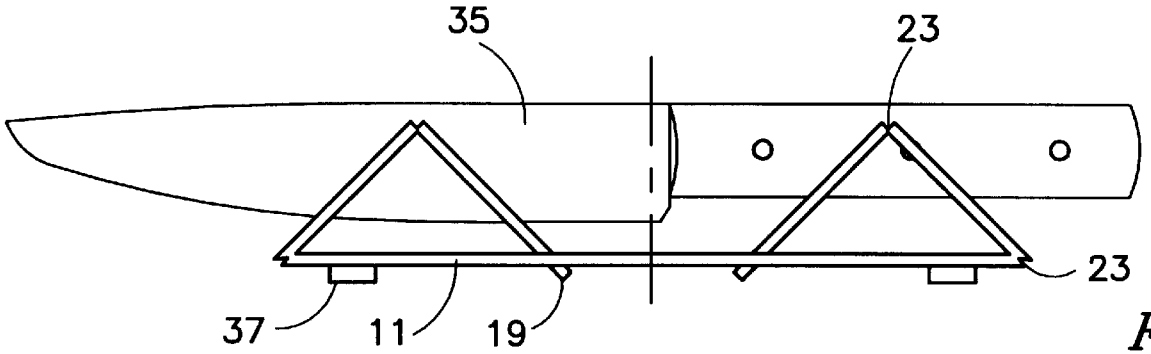
FIG. 3 is an illustration of a side elevation view of the first embodiment, showing how articles may be supported.
Figure 2:
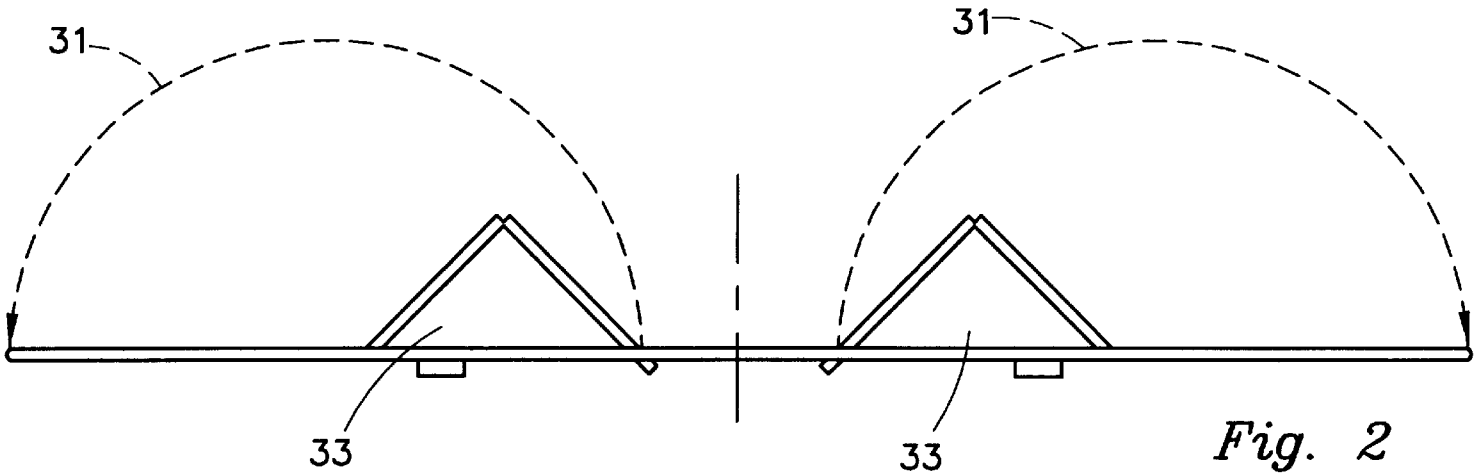
FIG. 2 is an illustration of a side elevation view of the first embodiment, showing how the rack may be folded.

FIG. 2 shows a side elevation view of the embodiment of this example. The rack is foldable by folding the body member along the hinge portions described above, moving along the folding paths indicated 31, to form two portions having triangular cross sections 33. For a rack with holes with dimensions similar to those shown for holes 25 and 27, the rack is suited for supporting one or more knives. FIG. 3 shows the rack of this embodiment with a knife 35 being supported. Also shown in FIG. 3 is a foot support 37 that can be optionally used on a major face of the body member to make the rack more stable. The use of a plurality of foot supports 37 allows the new rack to be supported at additional points to the securing tabs indicated by 19.

EXAMPLE 2

Figure 4:
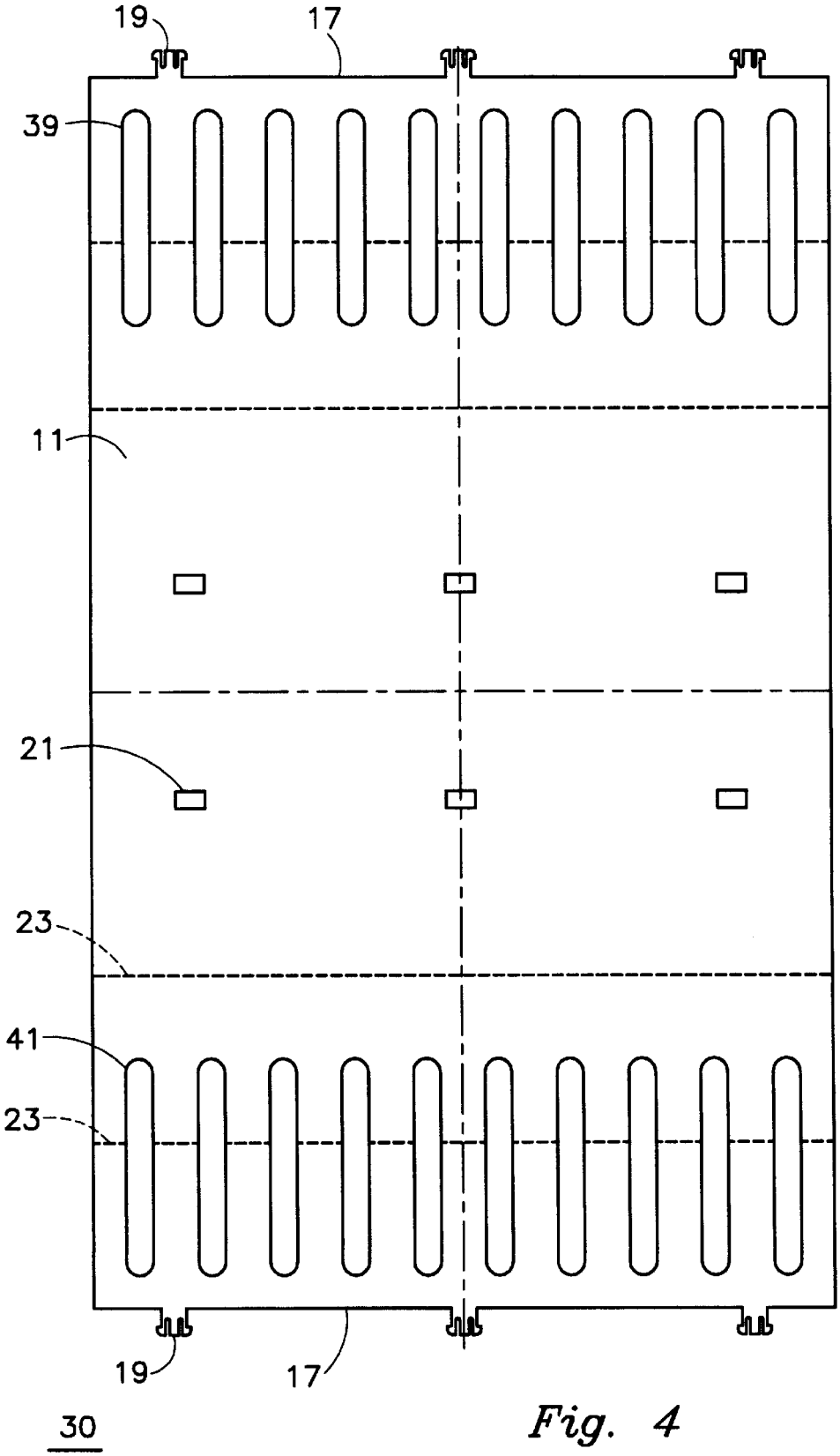
FIG. 4 is an illustration of a top plan view of a second embodiment of a foldable support rack according to the invention.

An alternative embodiment 30 of the new rack is shown in FIG. 4. The plan view of this embodiment shows that it has elements similar to that of the first embodiment. The article receiving holes for supporting an article to be supported, 39 and 41, are dimensioned differently than in the first embodiment. These holes can be sized and shaped in a wide variety of ways to accommodate a wide range of articles to be supported. For this embodiment, the rack is folded in the same manner as for the first embodiment to form a rack in a second supporting position.

EXAMPLE 3

Figure 5:
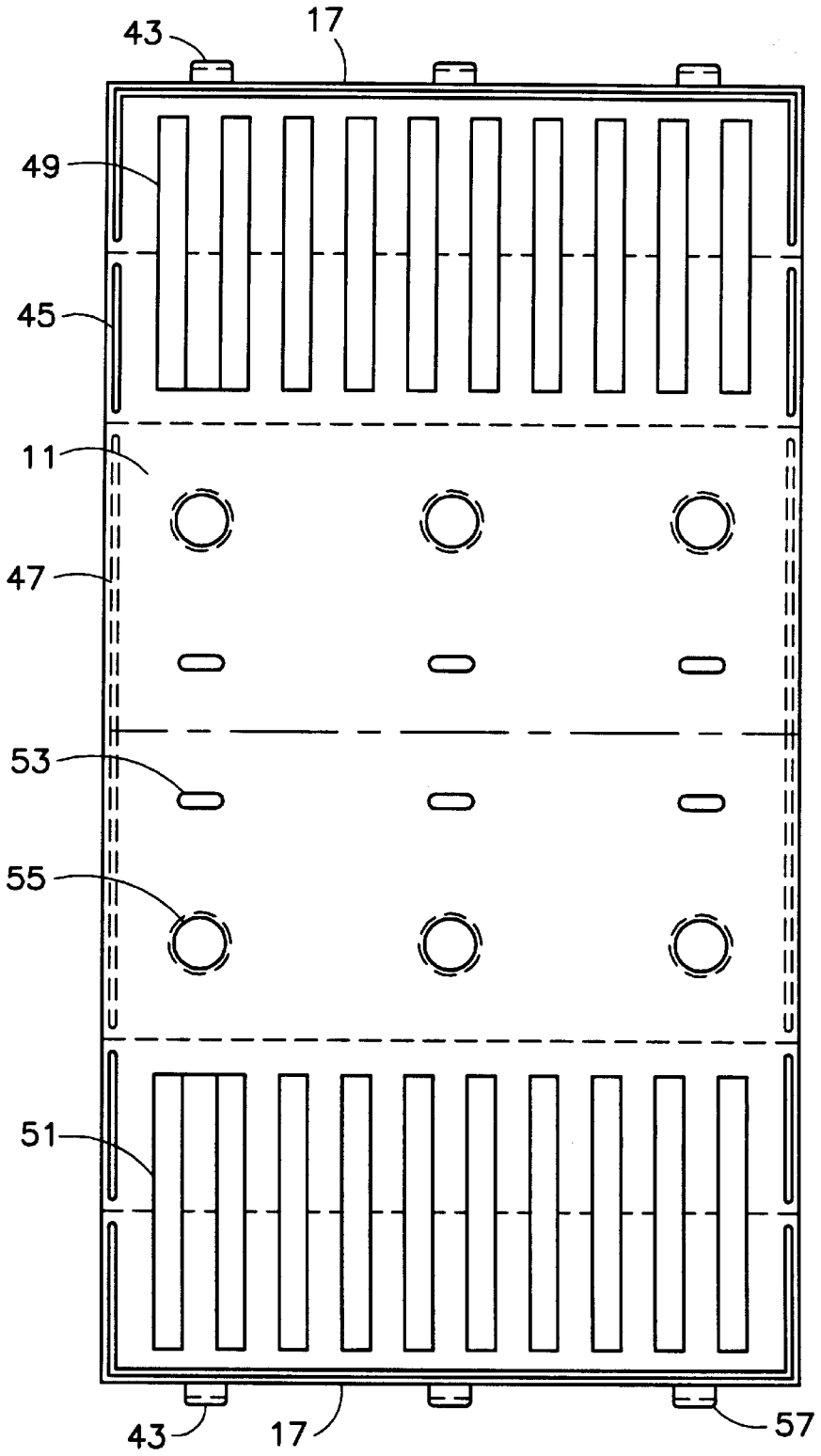
FIG. 5 is an illustration of a top plan view of a third embodiment of a foldable support rack according to the invention, the rack having a different securing tab than in the second embodiment.

FIG. 5 depicts an additional embodiment 40 of the inventive rack. In this exemplary form of the rack, the securing tabs 43 have a different shape than that used in the earlier embodiments above. These tabs 43 have at least one raised ridge 57 extending from a major face of the tabs. This raised ridge acts to secure an adjacent end of the body member to one of the plurality of holes 53 for receiving and engaging these tabs. The holes 53 and tabs 43 with raised ridge 57 are dimensioned to allow the holes to closely engage the tabs. The articles receiving holes 49 and 51 for this embodiment may be different in size and shape than those described in the previous examples.

Also shown in FIG. 5 are optional supporting feet 55, which may be different in size and shape than the supporting feet 37. These feet may be separate elements that are applied to a major face of the rack, or they may be molded onto the body member as integral elements. This figure also shows raised ribs 45 and 47, that can optionally be molded onto either major face of the body member. Such raised ribs are preferably parallel to the peripheral edge of the body member. They can provide additional stiffness to the body member if heavy articles are to be supported on the inventive rack.

Figure 6:
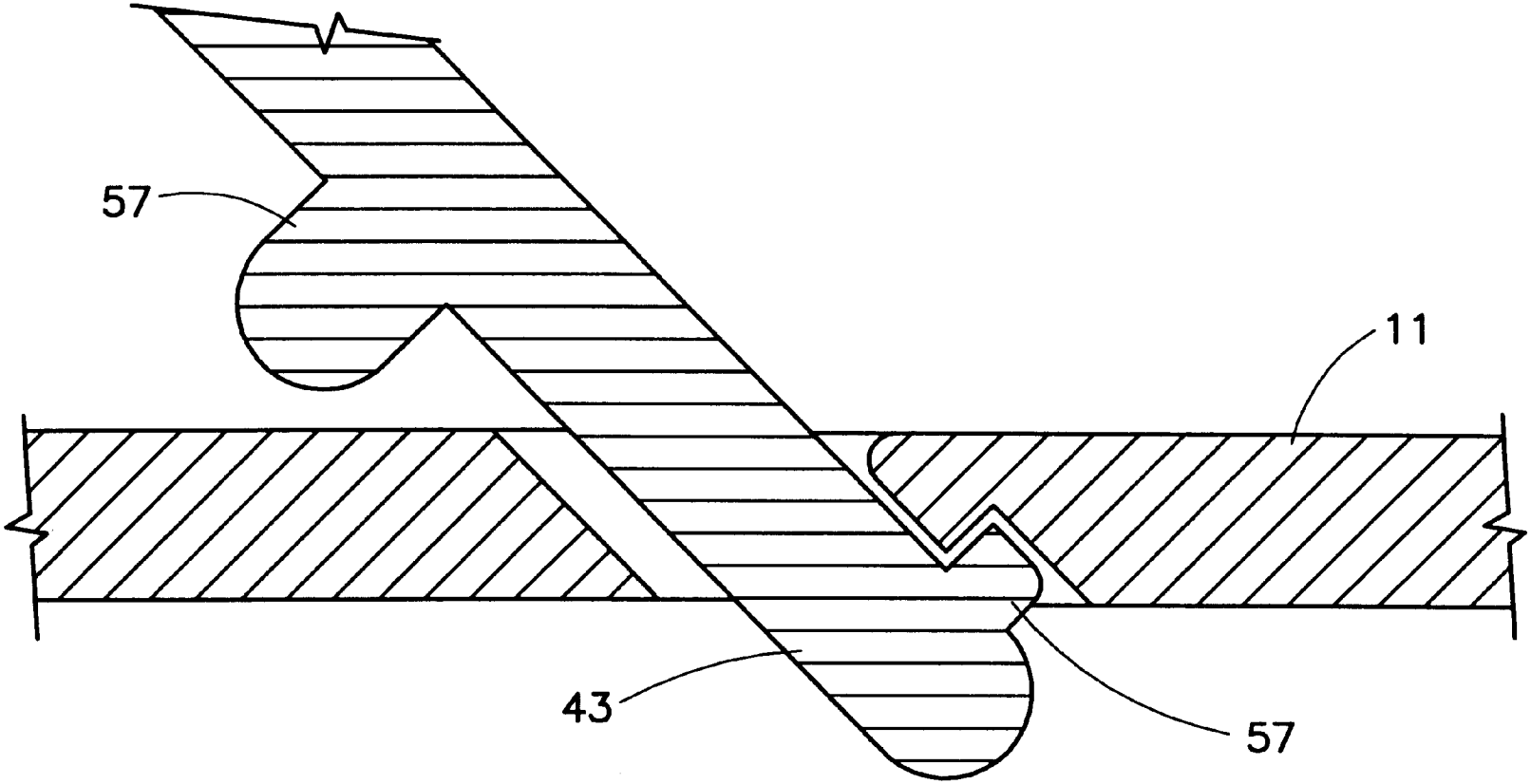
FIG. 6 is an illustration of an elevation view of securing tab of the embodiment of FIG. 5, with the securing tab engaged in a receiving hole.

FIG. 6 shows how a raised ridge 57 is used to for closely engaging a hole for receiving 53.

Figure 7:
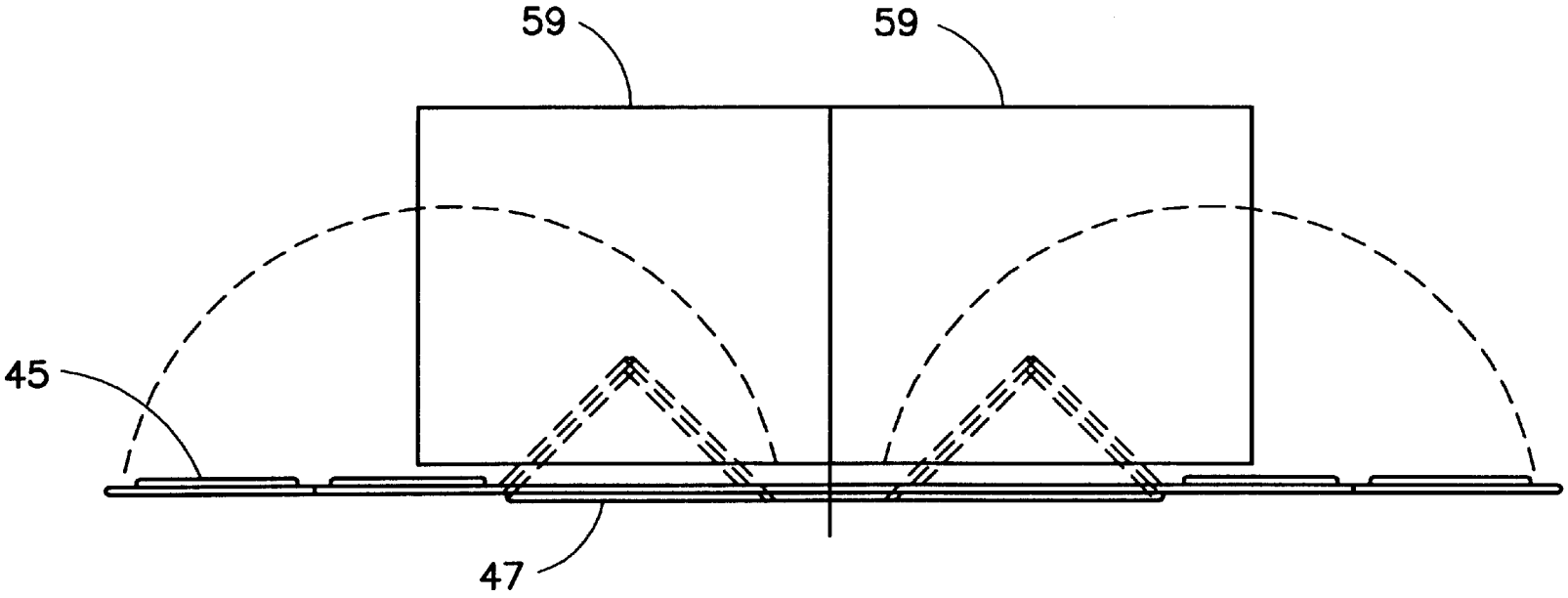
FIG. 7 is an illustration of a side elevation view of the embodiment of FIG. 5, showing the folding of the rack, and articles being supported.

FIG. 7 shows how the embodiment of this example can be used to hold computer or audio compact disks 59. It is to be understood, that if the height of a raised rib 47 is sufficiently high above the body member, the end of tab 43 that extends through receiving hole 53 is sufficient to allow the rack to rest on raised rib 47 on a flat surface. The use of an appropriately sized raised rib then obviates the need for additional feet such as those shown as 37 and 45.

EXAMPLE 4

Figure 8:
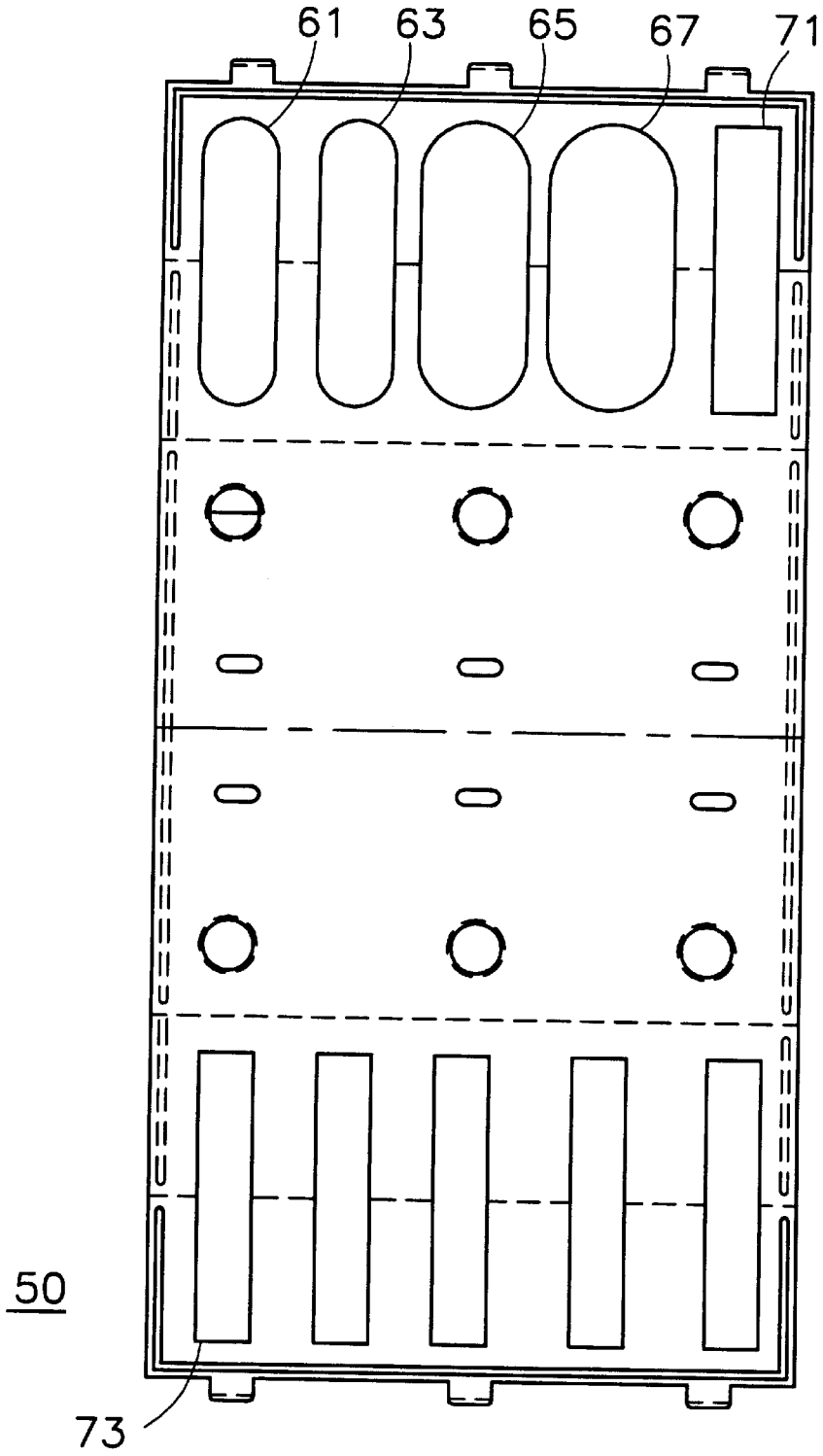
FIG. 8 is an illustration of a plan view of a fourth embodiment of a foldable support rack according to the invention.
Figure 9:
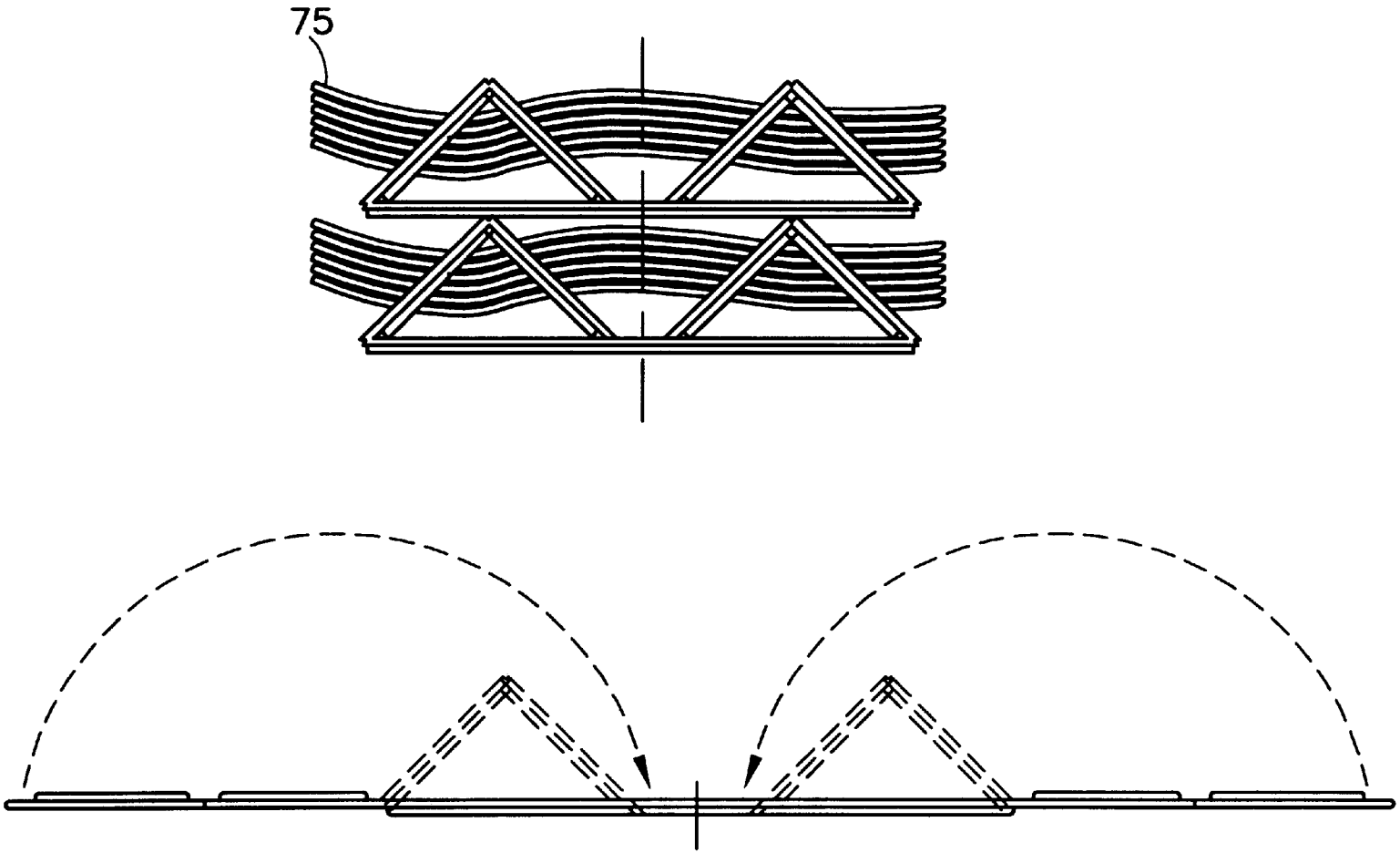
FIG. 9 is an illustration of a side elevation view of the embodiment of FIG. 8, showing the folding of the rack, and how the rack holds articles.

FIG. 8 shows another exemplary embodiment 50 of the new rack. In this embodiment it is shown that the article receiving holes 61, 63, 65, 67, 71, and 73, may all be given different dimensions. Doing so can allow a rack according to the invention to accommodate articles with different shapes. In this embodiment, it was found that the receiving holes shown would accommodate different types of eating utensils, such as knives, forks and spoons. FIG. 9 shows an elevation view of this exemplary embodiment with pieces of cutlery 75 stacked in a rack according to this embodiment. This figure also illustrates that it is to be understood that two or more racks according to the present invention may be stacked one-upon-another for convenience.

EXAMPLE 5

Figure 10:
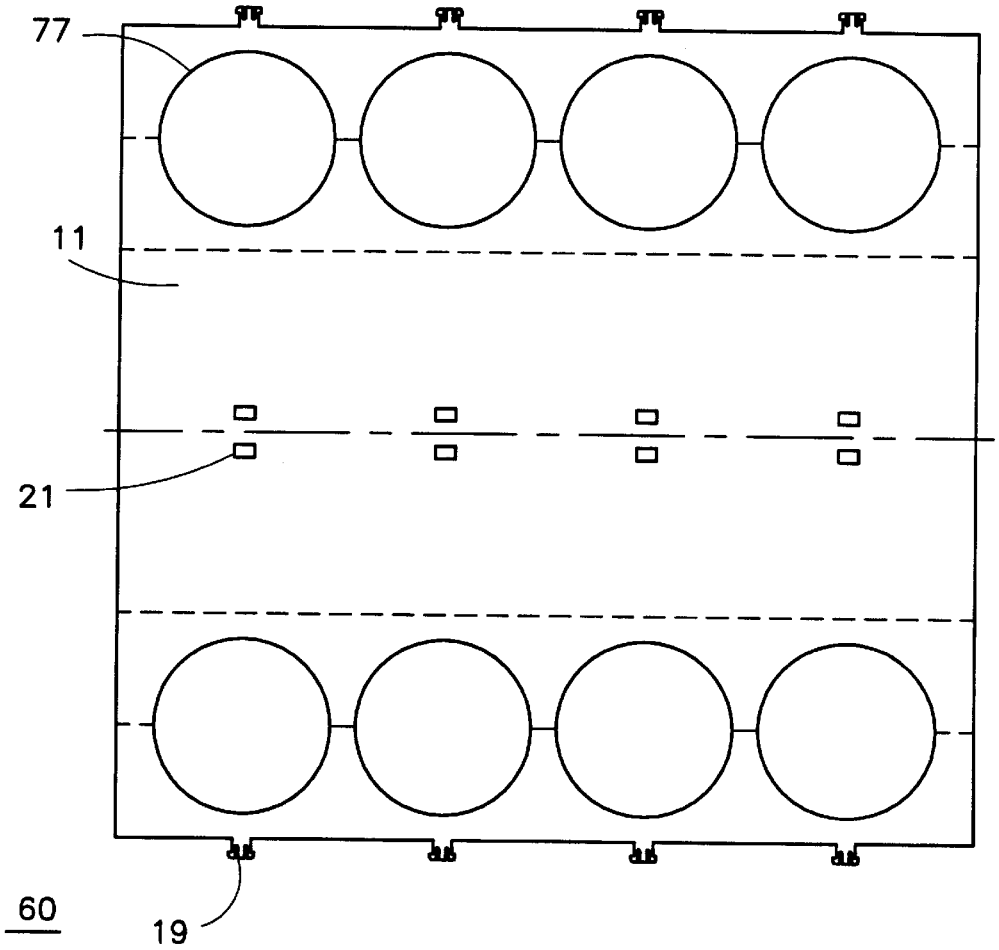
FIG. 10 is an illustration of a plan view of a fifth embodiment of a foldable support rack according to the invention.
Figure 11:
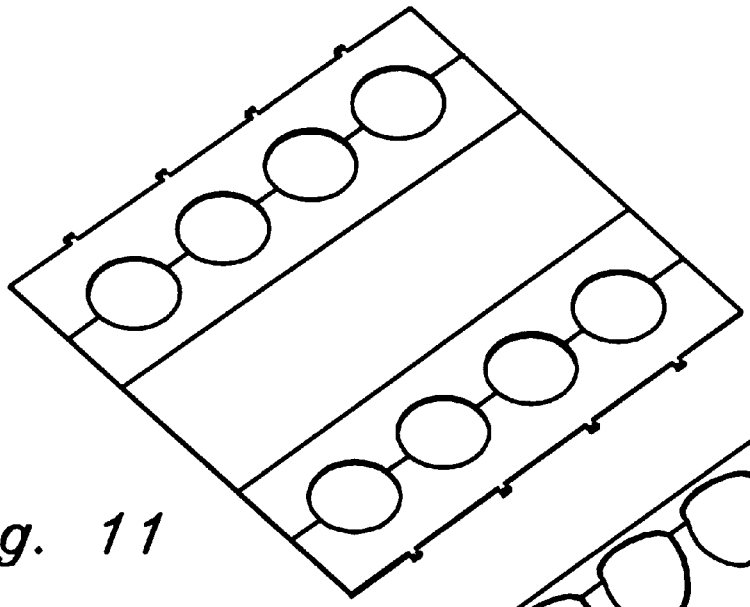
FIG. 11 shows a perspective view of the embodiment of FIG. 10.
Figure 12:
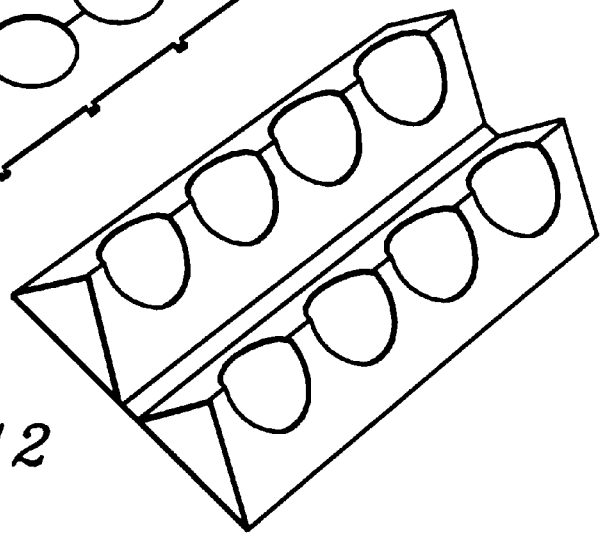
FIG. 12 is an illustration of the folding of the embodiment of FIG. 10.
Figure 13:
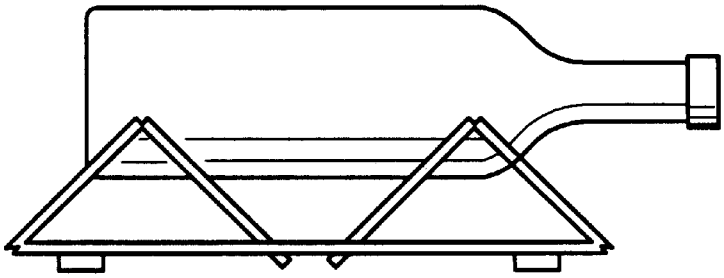
FIG. 13 is an illustration of a side view of the embodiment of FIG. 10, showing the supporting of a bottle article on the rack.
Figure 14:
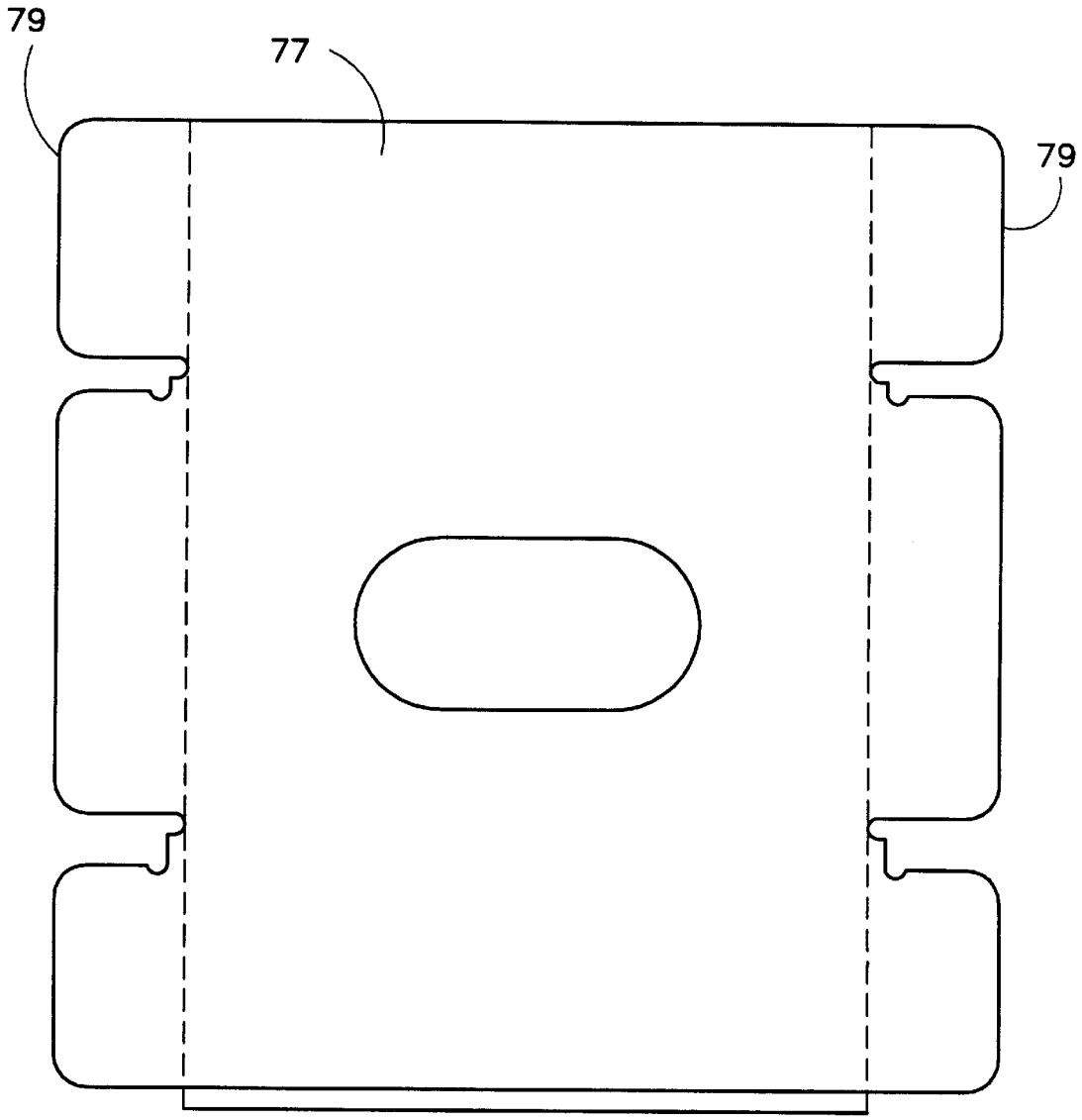
FIG. 14 is an illustration of a stacking member, that can be used for stacking two of the racks according to the embodiment of FIG. 10, above one another.

FIG. 10 shows another embodiment 60. In this embodiment it may be seen that the number of securing tabs and the number of holes for receiving and engaging the tabs can be different for a rack that is used for supporting different articles. The article receiving holes 77 for this embodiment were sized and shaped for supporting a wine bottle. FIG. 1I shows a perspective view of the rack of this embodiment in a first extended position. FIG. 12 shows this rack in a second supporting position. FIG. 13 shows a side elevation of the rack with a wine bottle supported.

EXAMPLE 6

Figure 15:
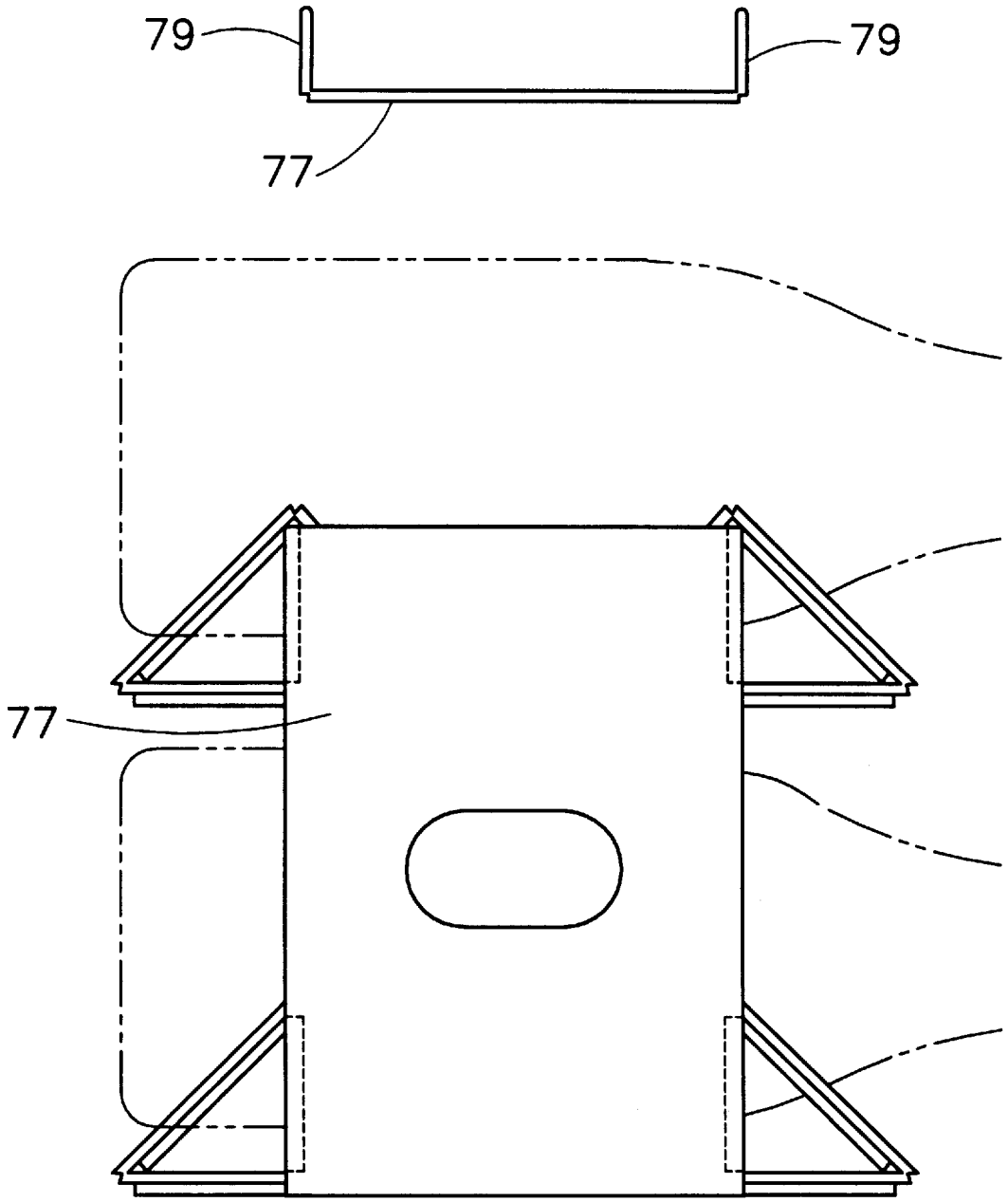
FIG. 15 is an illustration of the stacking member of FIG. 14 used with the rack embodiment of FIG. 10.

The present invention also includes a stacking member 70 that may be used with a rack according to the invention. This stacking member 70 comprises a generally flat wall member 77, that is made of a rigid material. The wall member has four peripheral edges. The wall member also has a plurality of foldable tabs 79 extending from two opposing peripheral edges. The tabs should preferably be capable of folding to a position orthogonal to the wall member. These tabs 79 are folded to allow the engagement of the tabs to a rack according to the invention. As shown in the elevation view of FIG. 15, and the end view of the upper portion of FIG. 15, the stacking member can be used to engage two racks as described in the earlier examples. This allows the stacking member to hold two racks one-above-the-other, and provides additional support for a heavy article such as a wine bottle.

The present invention is not to be limited in scope by the embodiments disclosed herein, which are intended as single illustrations of one aspect of the invention, and any which are functionally equivalent are within the scope of the invention. Indeed, various modifications of the invention, in addition to those shown and described herein, will become apparent to those skilled in the art from the foregoing description. Such modifications are intended to fall within the scope of the appended claims.

I claim:

1. A foldable support rack, comprising:

a body member, generally flat, having first and second opposed major faces, and having a peripheral edge; the peripheral edge comprising: first and second opposed side edges, and first and second opposed end edges; wherein the body member has a first plurality of holes for receiving and engaging a plurality of securing tabs that are disposed along the first and second opposed end edges, and are equal in number to the first plurality of holes; and the body member has four transverse hinge portions, spaced to allow folding of the body member from a first extended position to a second supporting position, the second supporting position comprising two supporting portions, each having a triangular cross section, on a substantially flat base, and the body member has a second plurality of holes such that when the body member is folded into the second supporting position the second plurality of holes comprise at least two article receiving holes for supporting an article, and are disposed on the supporting portions, such that an article can be supported by engaging at least one of the at least two article receiving holes on one or both of the supporting portions.

2. The foldable support rack according to claim 1, wherein the hinge portions comprise living hinges.

3. The foldable support rack according to claim 1, wherein the securing tabs have first and second opposed side edges corresponding to the first and second side edges of the body member, and the securing tabs have prongs disposed along their first and second opposed side edges, and are dimensioned for closely engaging the receiving holes.

4. A foldable support rack according to claim 1, further comprising a plurality of raised ribs disposed on at least one major face of the body member, each of said plurality of raised ribs being generally parallel to the peripheral edge of the body member.

5. The foldable support rack according to claim 1, wherein the at least two article receiving holes are located and dimensioned for receiving a computer data storage medium box.

6. The foldable support rack according to claim 1, wherein the at least two article receiving holes are located and dimensioned for receiving an eating utensil.

7. The foldable support rack according to claim 1, wherein the at least two article receiving holes are located and dimensioned for receiving a knife.

8. The foldable support rack according to claim 1, wherein the at least two article receiving holes are located and dimensioned for receiving a bottle.

9. The foldable support rack according to claim 1, further comprising at least four supporting feet disposed on at least one major face of the body member.

10. The foldable support rack according to claim 1, further comprising at least four supporting feet disposed on at least one major face of the body member and integral with the body member.

11. A foldable support rack, comprising:

a body member, generally flat, having first and second opposed major faces, and having a peripheral edge; the peripheral edge comprising: first and second opposed side edges, and first and second opposed end edges; wherein the body member has a plurality of holes for receiving and engaging a plurality of securing tabs that are disposed along the first and second opposed end edges, and are equal in number to the plurality of holes; and the body member has four transverse hinge portions, spaced to allow folding of the body member into two portions having triangular cross sections; and wherein the rack is foldable from a first extended position to a second supporting position, and wherein the securing tabs have first and second opposed major faces corresponding to the first and second opposed major faces of the body member, and the securing tabs have raised ridges disposed along their major faces and are dimensioned for closely engaging the receiving holes.

12. A foldable support rack, comprising:

a body member, generally flat, having first and second opposed major faces, and having a peripheral edge; the peripheral edge comprising: first and second opposed side edges, and first and second opposed end edges; wherein the body member has a plurality of holes for receiving and engaging a plurality of securing tabs that are disposed along the first and second opposed end edges, and are equal in number to the plurality of holes; and the body member has four transverse hinge portions, spaced to allow folding of the body member into two portions having triangular cross sections; and wherein the rack is foldable from a first extended position to a second supporting position, and at least one stacking member, the at least one stacking member comprising: a generally flat wall member, having four peripheral edges; the wall member also having a plurality of foldable tabs extending from two opposing peripheral edges; wherein the foldable tabs are foldable by about ninety degrees to engage the opposed side edges of the foldable support rack, and wherein the at least one stacking member is dimensioned for supporting a second foldable support rack parallel to and above the foldable support rack.

* * * * *